US007185843B1

(12) United States Patent
Li

(10) Patent No.: US 7,185,843 B1
(45) Date of Patent: Mar. 6, 2007

(54) TWO HIGH BATHROOM TISSUE DISPENSER

(76) Inventor: Wayne W. Li, 72 Webb Dr., Troy, MI (US) 48098

( * ) Notice: Subject to any disclaimer, the term of this patent is extended or adjusted under 35 U.S.C. 154(b) by 0 days.

(21) Appl. No.: 11/164,184

(22) Filed: Nov. 14, 2005

(51) Int. Cl.
*B65H 16/06* (2006.01)

(52) U.S. Cl. ..... 242/596.4; 242/560; 242/596.8

(58) Field of Classification Search ..... 242/596, 242/596.1, 596.2, 596.3, 596.4, 596.7, 596.8, 242/560, 560.1, 561; 312/34.22
See application file for complete search history.

(56) References Cited

U.S. PATENT DOCUMENTS 2,904,274 A * 9/1959 Hicks ..... 242/596.3
2,920,833 A * 1/1960 Bolger ..... 242/596.1
3,050,268 A * 8/1962 Mortenson ..... 242/596.1
3,220,660 A * 11/1965 Bolger ..... 242/596.1
4,522,346 A * 6/1985 Jespersen ..... 242/596.3
5,449,127 A * 9/1995 Davis ..... 242/560

* cited by examiner

*Primary Examiner*—William A. Rivera

(57) ABSTRACT

A two high bathroom tissue dispenser is designed to provide users with a bathroom tissue dispenser that holds two rolls at a time. It is simply comprised of a housing, a pair of opposing side supports, and a cover. The housing has front, rear, side, and bottom walls, an empty core holder, and a discharge opening. Each support consists of a plate hingedly secured to the sidewalls, roll hanger to pick up and hold a bottom bathroom tissue roll, a snap, and a block.

4 Claims, 2 Drawing Sheets

TWO HIGH BATHROOM TISSUE DISPENSER

BACKGROUND OF THE INVENTION

1. Field of the Invention

The present invention relates generally to a device for holding a particular of rolls such as bathroom tissue and the like, and, more particularly, it permits a roll of tissue to be used while another roll is retained in storage.

2. Background of the Prior Art

Efforts have been made to find ways to store spare bathroom tissue rolls while a roll is being used. The spare tissue rolls are stored either vertically or horizontally with the dispensing roll. Some devices retain only one spare roll, and some can store more than one vertically. They are installed on a wall or placed upon a counter top.

Most of the bathroom tissue dispensers have a spindle to hold the tissue roll that is unrolled. Certain effort needs to be made to replace a spent roll of the tissue, especially to guide the two ends of the spindle to the holes in the two arms that hold the spindle in stationary position.

However, for the two bathroom tissue holder/dispenser, the device can be made simpler so that it becomes more user friendly and is manufactured easily.

SUMMARY OF THE INVENTION

The present invention is directed to overcoming some current problems and to making a simpler, user friendly, and more efficient bathroom tissue dispenser that can store one spare tissue roll while another one is used. The two high bathroom tissue dispenser is designed to properly characterize the working functions of the product as well as define the physical appearance. Typical use of the product, its basic design, and production materials are considered.

The two high bathroom tissue dispenser is basically made of plastics or steels. It is designed to provide users with a bathroom tissue dispenser that holds two rolls at a time as shown in the design drawing. It simply consists of a housing, a pair of supports, and a cover. The simple single act of opening the supports for both top and bottom rolls will allow the empty roll core to fall down to the bottom of the housing, and the second full roll into place for use. That makes it easy to secure the roll there, remove the empty core at the bottom from the dispenser, and then replace the upper spare roll after closing the supports. The dispenser housing will measure only slightly larger than two rolls of toilet paper stacked on top of one another.

The bottom portion of the dispenser has an open front for easy access to the roll in use. As noted, at the very bottom of the dispenser housing there is a core holder that holds the empty roll core when it falls. Under the normal condition, the left and right supports are in a close position. That is assured by left and right snap mechanisms at the end of the supports as shown in design drawing. When the fingers lift the bottoms of the supports on either side of the dispenser, the supports can be unlocked and flipped up and out from the exterior sides of the housing, so that the supports are in open position. The opened supports release the empty roll core, and allow the upper spare roll to fall into place over the empty core. The supports can then be swung back down and automatically snapped into place to hold the fallen roll, so that the bathroom tissue can be dispensed. After that, a fresh spare can be dropped into the top of the two high bathroom tissue dispenser while taking the empty roll core away. Due to the special structure of lower portion of the supports, the dispenser is suitable for bathroom tissue with different outside diameters. The support's closing process makes the tissue up slightly to form a gap between the tissue and the internal bottom surface of the housing so that the friction force between them can be avoided.

The unique characteristics for that are simple and user-friendly. Only opening the supports would do two things at the same time—drop the top roll, and drop the bottom core. That is easier to be used and manufactured than currently used dispensers. It can be used in the bathrooms of office buildings or family apartments/houses.

Colors and other aesthetic considerations for the two high bathroom tissue dispenser can be as various as the custom desire, but should probably reflect the current trends in the toilet paper dispenser/bathroom accessories industry.

Due to the two high bathroom tissue dispenser's very simple components, it should be no problem to produce from any technical standpoint. Existing assembly lines could easily be adapted for its speedy manufacture.

DESCRIPTION OF THE PREFERRED EMBODIMENT

Figure 1:
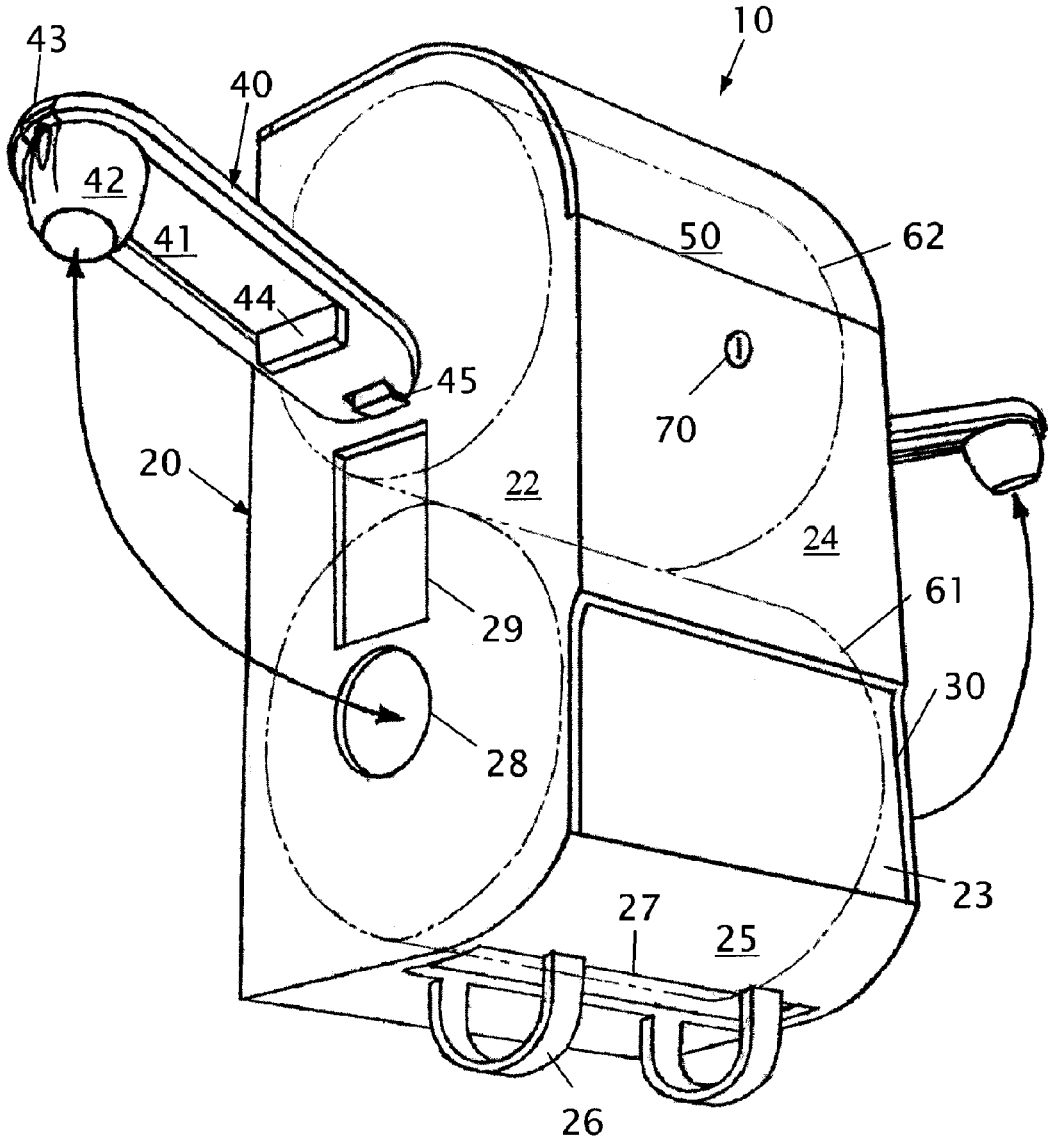
FIG. 1 is a perspective view of the two high bathroom tissue dispenser.
Figure 2:
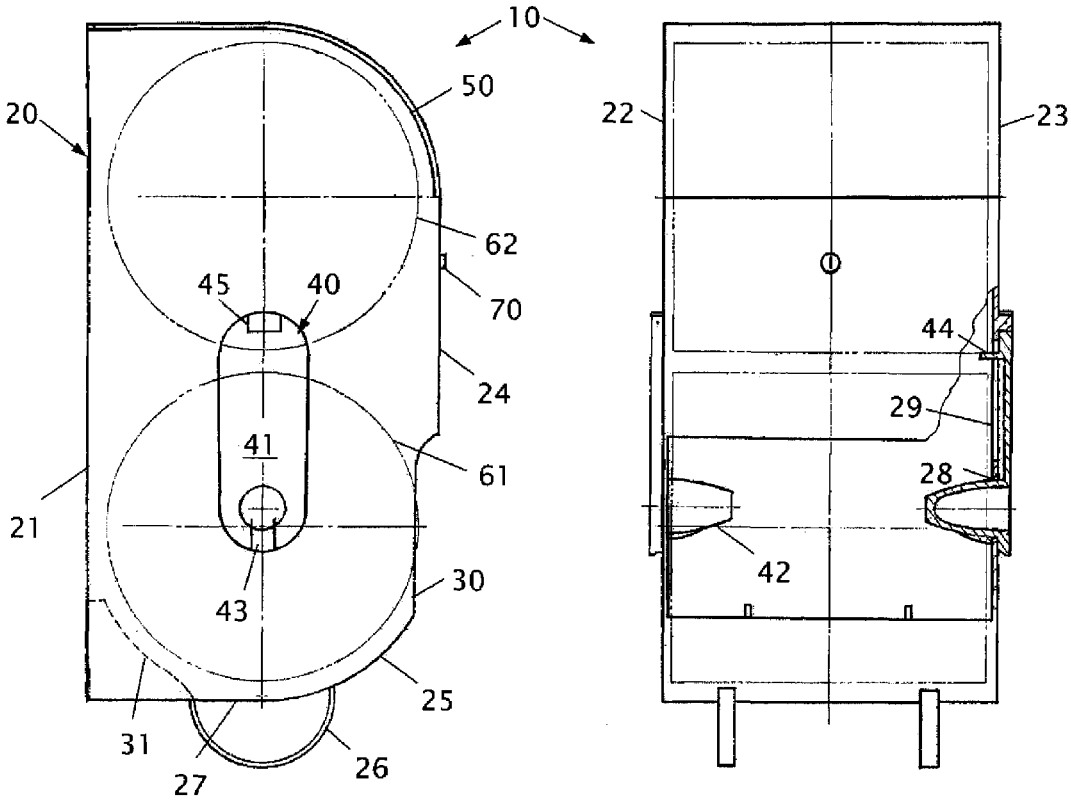
FIG. 2 is front and side views of the two high bathroom tissue dispenser.

Turning now to the drawings, in which similar reference characters denote similar elements throughout the several views, it is seen that the two high bathroom tissue dispenser, generally donated by reference number 10, is comprised of a housing 20, a pair of opposing side supports 40, and a cover 50. As seen, the housing 20 is comprised of rear wall 21, a pair of opposing sidewalls 22 and 23, front wall 24, bottom wall 25, an empty core holder 26, and a pair of guide ribs 31. When needed, a lock 70 can be used. Each support 40 has a plate 41 secured to the side wall by a hinge 45, roll hanger 42 to pick up and hold a bottom bathroom tissue roll 61, a snap 43 to prevent the support from flipping out when the supports are in the close state, and a block 44 to hold a top bathroom tissue roll 62. A discharge opening 30 exists near the bottom portion of the housing for easy access to the roll in use. There is a core drop opening 27 within bottom wall for empty core dropping. Each side wall has a circular opening 28 for access of roll hanger 42 and holding the snap 43, and a rectangular opening 29 to allow block to access and save materials.

Under the normal condition, the left and right supports 40 are in a close position. That is assured by left and right snaps 43. The bottom bathroom tissue roll 61 is held by the roll hangers 42, and the top roll by blocks 44. Upon exhaustion of the initial bathroom tissue roll, the snaps 43 are lifted slightly by fingers to unlock the supports 40 and continuously the supports 40 are flipped up and out from the exterior sides of the side walls 22 and 23. As a result, the supports 40 are in open position and the empty roll core is released, guided by guide ribs 31 and curved shape of the bottom wall 25, drops through the core drop opening 27, and finally is held by the empty core holder 26. And the upper spare roll 62 also falls into place. The supports 40 are then swung back down and automatically snapped into place to lift slightly and hold the fallen roll, so that the bathroom tissue can be dispensed. After that, a fresh spare roll is dropped into the top portion of the two high bathroom tissue dispenser 10 while taking the empty roll core away.

The support's closing process makes the new tissue roll up slightly to form a gap between the tissue roll and the internal bottom surface of the housing 20 so that friction force between them can be avoided and the tissue can be easily dispensed. Due to the special structure of lower portion of the supports 40, the two high bathroom tissue dispenser 10 is suitable for bathroom tissues with different outside diameters.

It is to be understood that the present invention is not limited to the above-mentioned embodiments, but encompasses any and all embodiments within the following scope of the claims.

What is claimed is:

1. A two high bathroom tissue dispenser comprising:

a housing, having vertically oriented front, rear and opposing side walls, a curved bottom wall, a discharge opening in a lower portion of the housing, and a pair of guide ribs in a lower, rear portion of the housing;

a core drop opening within the bottom wall to drop an empty roll core;

a pair of opposing, vertically oriented rectangular openings within the sidewalls;

a set of opposing, vertically oriented circular openings below the rectangular openings within the sidewalls;

a pair of supports, having plates hingedly attached to the sidewalls, roll hangers to pick up and hold a bottom tissue roll, and snaps designed according to the shape of the roll hangers to work together with the circular openings to assure a close state of the supports;

a cover, near the top of the housing; and wherein when the two high bathroom tissue dispenser is in a normally relaxed state, the supports are in a close position, upon lifting bottoms of the supports and flipping up and out the supports from the exterior sides of the side walls, an empty roll core drops through the guide ribs and the curved bottom wall surface and core drop opening and the upper roll also falls into place, and when the supports are swung back down and automatically snapped into place to lift slightly and hold the fallen roll, the bathroom tissue can be dispensed, and a fresh spare roll is dropped into the top portion of the dispenser later while taking the empty roll core away.

2. The two high bathroom tissue dispenser of claim 1, wherein said housing has an empty core holder to hold the empty roll core.

3. The two high bathroom tissue dispenser of claim 1, wherein each said support has a block to be used to prevent the upper tissue roll from dropping down when the supports are in a close state.

4. The two high bathroom tissue dispenser of claim 1, wherein said housing has a lock.

* * * * *